United States Patent [19]

Henderson et al.

[11] 4,387,256

[45] Jun. 7, 1983

[54] TRACTION FLUID LUBRICANTS DERIVED FROM COAL TAR

[75] Inventors: Harry E. Henderson, Sarnia; Clinton R. Smith, Camlachie; A. Gordon Alexander, Sarnia, all of Canada

[73] Assignee: Imperial Oil Limited, Toronto, Canada

[21] Appl. No.: 183,361

[22] Filed: Sep. 2, 1980

[51] Int. Cl.[3] ..... C07C 15/12

[52] U.S. Cl. ..... 585/1; 585/25; 208/19; 208/22; 208/23; 208/44

[58] Field of Search ..... 585/1, 25; 208/19, 22, 208/23, 44

[56] References Cited

U.S. PATENT DOCUMENTS

| | | | |
|---|---|---|---|
| 3,411,369 | 11/1968 | Hammann et al. | 74/200 |
| 3,440,894 | 4/1969 | Hammann et al. | 74/200 |
| 3,595,796 | 7/1971 | Duling et al. | 252/73 |
| 3,598,740 | 8/1971 | Duling et al. | 252/73 |
| 3,714,021 | 1/1973 | Takashahi et al. | |
| 3,843,537 | 10/1974 | Duling et al. | 252/59 |
| 3,975,278 | 8/1976 | Wygant | 585/1 |
| 4,101,416 | 7/1978 | Dolbear | 208/44 |
| 4,155,832 | 5/1979 | Cox et al. | 208/44 |
| 4,219,687 | 8/1980 | Dolhyj et al. | 585/25 |

FOREIGN PATENT DOCUMENTS

| | | | |
|---|---|---|---|
| 2031944 | 4/1980 | United Kingdom | 585/1 |

OTHER PUBLICATIONS

"Organic Chemistry" by E. Wertheim, 1951, p. 48, McGraw-Hill, N.Y.

"Asphalts & Allied Substances" by Herbert Abraham, pp. 73-75, D. Van Nostrand Co., N.Y.

Kirk-Othmer, "Encyclopedia of Chemical Technology" 2nd Ed., vol. 19, 1969, pp. 653-682.

"Encycopedia of Science and Technology" by McGraw-Hill, vol. 6, 1971, pp. 623-625.

*Primary Examiner*—Jacqueline V. Howard

*Attorney, Agent, or Firm*—Eugene Zagarella, Jr.

[57] ABSTRACT

A traction fluid having a lubricant basestock comprising hydrogenated coal tar containing a saturated fraction having a major portion made up of multiring components of at least three rings and an aromatic fraction which comprises at least 12% by weight of said fluid and contains at least 50% by volume of multiring components.

11 Claims, No Drawings

TRACTION FLUID LUBRICANTS DERIVED FROM COAL TAR

BACKGROUND OF THE INVENTION

This invention relates to selected coal tar compositions which are useful as lubricant basestocks in traction fluids. More particularly, the invention is directed to a traction fluid composition having a lubricant basestock which comprises hydrogenated coal tar containing a saturated fraction having a major portion made up of multiring components of at least three rings and an aromatic fraction which comprises at least about 12% by weight of said fluid and which fraction contains at least 50% by volume of multiring aromatic components.

Traction fluid is a term used to identify a class of lubricants that give superior performance in traction drives. A traction drive transfers force from one rotating shaft to another through a rolling contact. Efficient transfer requires that a minimum amount of slippage occurs. This property is measured by the traction coefficient which is defined as force transmitted divided by the normal force which keeps the rolling members in contact.

The coefficient of traction as defined above, has been one of the prime measurements used in defining useful traction fluids. Various studies have been made attempting to define the type of structures associated with higher traction properties. Thus, some of the more suitable structures which have been reported include U.S. Pat. No. 3,411,369 which discloses fused, saturated carbon containing rings; U.S. Pat. No. 3,440,894 which discloses organic compounds containing a saturated carbon containing ring or an acyclic structure having at least three quaternary carbon atoms; U.S. Pat. Nos. 3,595,796 and 3,598,740 disclose the use of selected naphthenes and branched paraffins; and U.S. Pat. No. 3,843,537 disclosed the use of naphthenes, partially saturated precursors of naphthenes, hydrorefined mineral oils, polyolefins and branched paraffins.

Generally, the structures defined in the literature as having good traction properties have not included aromatic constituents. This is exemplified by U.S. Pat. Nos. 3,595,796; 3,598,740 and 3,843,537 which indicate the general undesirability of aromatic unsaturation as it relates to traction properties and the need to limit aromatic content to very low levels.

DETAILED DESCRIPTION OF THE INVENTION

Now in accordance with this invention it has surprisingly been found that selected coal tar compositions which contain significant amounts of aromatic constituents are particularly useful as traction fluid lubricants. More particularly, this invention is directed to a traction fluid composition having a lubricant basestock which comprises hydrogenated coal tar containing a saturated hydrocarbon fraction having a major portion made up of multiring components of at least three rings and an aromatic fraction which comprises at least about 12% by weight of said fluid and which fraction contains at least 50% by volume of multiring aromatic components.

The ability to ascertain the surprising attributes of aromatic constituents in traction fluids was in part the result of a newly developed technique for evaluating traction properties. This technique involved development of a traction index which is based on the rolling torque generated and the amount of slippage found in the rolling contact. Further details of this technique will be described in detail later on in the specification.

The coal tar material on which the composition of this invention is based is the well-known material of this name and derived from the destructive distillation or carbonization of coal. Such tars are complex mixtures of mainly aromatic and heterocyclic ring compounds contaminated with only small amounts of nonaromatic hydrocarbons. Generally, such material includes about 89 wt. % carbon and 6 wt. % hydrogen and some of the more prominent constituents include single-ring compounds such as benzene, toluene, xylene, phenol, cresols, xylenols, pyridine and methylpyridines; fused six- and five-membered ring systems such as hydrindene, indene, coumarone and indole and components which include two six-membered rings, two six-membered and one five-membered rings and three six-membered rings such as naphthalene and phenanthrene. Other unsubstituted aromatics which are prominent include acenaphthene, fluorene and anthracene. Further description of the material coal tar may be found in Kirk-Othmer "Encyclopedia of Chemical Technology", Second Edition, Vol. 19, 1969, pp 653–682.

The selected coal tar compositions of this invention are hydrogenated coal tar materials which are selectively fractionated to yield a composition which contains a saturate fraction and an aromatic fraction. Generally the weight ratio of aromatics to saturates will be at least about 0.1:1, preferably at least about 0.2:1 and more preferably at least about 0.5:1. The saturate fraction will generally have a major portion, i.e. greater than 50% by volume, made up of multiring components of at least three rings. More particularly the saturate fraction will have a volume ratio of multiring (three or more rings) to 1-2-ring components of at least about 1:1, preferably at least about 3:1 and more preferably at least about 4:1. The aromatic fraction will generally comprise at least about 12% by weight of the composition and preferably at least about 20% and more preferably at least about 30% by weight. The aromatic fraction will contain at least about 50% by volume of multiring components having two or more rings at least one of which is an aromatic ring, preferably at least about 60% and more preferably at least about 66.7% by volume.

The multiring portion of the aromatic fraction is generally comprised of naphthalenes, acenaphthenes, fluorenes and phenanthrenes. It is understood that branched or substituted ring components are also included in the defined aromatic fraction.

The coal tar product of this invention is prepared by first hydrogenating the feed coal tar material followed by separation using either distillation or thermal diffusion. All of these techniques involve standard operating conditions. Generally, the hydrogenation procedure is followed to essentially complete hydrogenation using normal techniques such as disclosed in the McGraw-Hill "Encyclopedia of Science and Technology", Vol. 6, 1971, pp 623–625.

In addition to the lubricant basestocks of this invention, additives designed to enhance specific properties of the traction fluids can be added to the composition. Such additives include, for example, V. I. improvers, antiwear agents, corrosion inhibitors, antioxidants, dispersants, etc. Generally additive amounts of up to about 20%, preferably up to about 10% by weight are used in the traction fluids.

As indicated earlier, the ability to ascertain the surprising traction properties resulting from materials containing significant aromatic constituents was aided by a new technique for evaluating such traction properties. A traction index (TI) which is based on the rolling torque generated and the amount of slippage found in the rolling contact was formulated to rate the different fluid materials.

Table I shows the parameters used in rating the material and as defined therein:

$$TI = \frac{T_F + T_S + S_{5F} + \Delta S_R}{4}$$

with the different torque and slip factors used in ascertaining TI being further defined in said Table I. One other factor which was significant in determining whether a fluid would be a good traction fluid was recognition of the fact that slip itself must be considered as an important parameter aside from TI itself. This was because high torque values, as in the case of the coal tar feed material, may result in a rather high TI but due to the rather low slip values, the material itself may still not be a good candidate for a traction fluid.

The traction data was obtained on a modified Roxan four ball wear tester as described in ASTM D 2266-67. The traction tester used had a Brown modification consisting of a hydraulic cylinder which applied a normal load and an air bearing which allowed for accurate frictional measurements. Additionally, the tester had a machined pot which held a conforming race and allowed rolling contact to occur rather than the sliding contact required by the ASTM method (the bottom three balls in the four-ball pyramid were allowed to roll on conforming race). This tester was evaluated as a means for determining the traction properties by selecting a series of materials whose coefficients of traction had been previously determined and measuring their traction properties on such tester. As indicated in Table II, the Traction Index (TI) gave a linear correlation with literature traction coefficients and was therefore a valid method of evaluating traction properties.

Further details and illustrations of this invention will be found in the following examples.

EXAMPLE 1

A highly aromatic coal tar material having a boiling point range of 141°–473° C., viscosity of 6.63 cSt at 40° C. and 1.74 cSt at 100° C., VI 131.7, and specific gravity 1.0937 at 15.5° C. was used as the feed material.

The initial treatment of the coal tar involved hydrogenation in a one-1 autoclave under the following conditions: sample size about 500 ml; catalyst N.0104T $\frac{1}{8}''$ catalyst (Harshaw Chemical Co.); catalyst weight about 60 g; temperature about 288° C.; $H_2$ pressure about 123 kg/sq. cm.g or 1750 psig. The length of hydrogenation was about 40 hours which was repeated two or three times until the final sample was obtained. The finished product had the following properties: B. P. range 221°–385° C.; viscosity 4.90 cSt at 40° C. and 1.69 cSt at 100° C., VI 105 and density 0.9428;$n_D^{20}$ 1.5059.

Before hydrogenation, the nickel catalyst was activated by heating at atmospheric pressure to 426.7° C. for about one hour, cooling to room temperature and then reheating in the presence of $H_2$ (about 17.6 kg/sq. cm.g or 250 psig) to 100° C. over about a one-hour period and then to 315.6° C. for about two hours. The catalyst was then cooled to room temperature whence a measured volume of coal tar was added under nitrogen atmosphere. Upon completion, the nitrogen atomosphere was replaced with a hydrogen atmosphere and the hydrogen experiment was conducted according to the conditions previously outlined.

The hydrogenated coal tar material was subsequently separated by a standard column distillation which produced four fractions with the following boiling ranges: 124°–225° C.; 226°–278° C.; 279°–318° C. and 319°–553° C.

The resulting fractions were evaluated for traction properties using the test procedures previously described and the results shown in Table III.

EXAMPLE 2

A sample of coal tar material, the same as used in Example 1, was hydrogenated in an identical manner; however, it was separated using batch thermal diffusion. This was carried out in laboratory scale units of the vertical cylinder type with each column furnished with ten ports with a mean slit diameter of 0.03 cm. The total volume of each unit was 30 ml. The inner wall of the annulus was cooled by water to 57.2°–65.6° C. and the outer water was electrically heated to 115.6°–137.8° C. Operation involved filling the column with feed, allowing a period of time (about 14 days) for separation and sampling the ports starting from the top. This procedure was repeated until a total of about 12 ml was obtained for each fraction.

As in Example 1, the resulting fractions were evaluated for traction properties and the results given in Table III.

The results show that all the fractions identified in Table III are suitable as traction fluids with distillation fraction #4 and thermal diffusion #10 having particularly desirable traction properties.

Information regarding the analyses of the different fractions tested can be found in Table IV.

TABLE I

PARAMETERS FOR RATING OILS BY TRACTION TESTER(1)

| Parameter | Symbol | Good Performance | Poor Performance | Rating Factor |
|---|---|---|---|---|
| Torque: 150 kg, 115 cm/sec, 65° C.(g-cm) | $T_{3000}$ | >220 | <150 | |
| Torque Factor, 150 kg | $T_F$ | 1 | 0 | $(T_{30000} - 150)/70$ |
| Torque: 150 kg, 7.7 cm/sec, 65° C.(g-cm) | $T_{200}$ | >220 | <150 | |
| Torque Speed Dependence | $T_S$ | 1 | 0 | $(1 - (T_{200} - T_{3000})/200$ |
| % Slip: 5 kg, 192 cm/sec, 65° C. | $S_5$ | >2.5 | <1.0 | |
| % Slip Factor, 5kg | $S_{5F}$ | 1 | 0 | $S_5/2.5$ |
| % Slip 50 kg, 192 cm/sec, 65° C. | $S_{50}$ | ~0 | <1.0 | |
| Slip Load Dependence | $\Delta S_R$ | 1 | 0 | $(S_5 - S_{50})/S$ |

TABLE I-continued

PARAMETERS FOR RATING OILS BY TRACTION TESTER[1]

| Parameter | Symbol | Good Performance | Poor Performance | Rating Factor |
|---|---|---|---|---|
| Traction Index (TI) | | 1 | 0 | $\frac{T_F + T_S + S_{5F} + \Delta S_R}{4}$ |

[1]A good performance will give a TI of ≧1 while a poor performance will give a TI of ca. 0.

TABLE II

DATA FOR CORRELATING TRACTION TESTER WITH LITERATURE

| Lubricant | Viscosity (cSt, 65° C.) | Traction Index | Traction Coefficient (at 102 cm/sec) |
|---|---|---|---|
| MCT 10 Base (Solvent 150 neutral) | 12.0 | 0.57 | ca. 0.045 |
| Santotrac 50 (Monsanto) | 12.8 | 1.11 | 0.095 |
| Oleic Acid | 9.7 | 0.22 | 0.036 |
| Ethylene Glycol | 4.1 | 0.15 | 0.007 |
| Cyclohexanol | 6.7 | 0.49 | 0.056 |
| Diethylene Glycol | 5.5 | 0.39 | 0.031 |
| Santotrac EP-2 (Monsanto) | — | 1.16 | 0.108 |

TABLE III

PHYSICAL AND TRACTION PROPERTIES OF COAL TAR SAMPLES AND REFERENCE OILS

| Lubricant | Description | Visc. (cSt, 65° C.) | Traction Properties | | | | | | | | |
|---|---|---|---|---|---|---|---|---|---|---|---|
| | | | $T_{200}$ (g-cm) | $T_{3000}$ (g-cm) | $S_5$ | $S_{50}$ | $T_F$ | $T_S$ | $S_{5F}$ | $\Delta S_R$ | TI |
| MCT 10 Base | (Solvent 150 Neutral) | 12.30 | 235.7 | 192.3 | 0.96 | 0.42 | 0.57 | 0.78 | 0.38 | 0.56 | 0.57 |
| MCT 30 Base | (Solvent 600 Neutral) | 34.40 | 197.4 | 199.7 | 1.61 | 0.56 | 0.63 | 1.01 | 0.64 | 0.65 | 0.73 |
| MCT 60 Base | (Solvent 1200 Neutral) | 78.00 | 204.4 | 232.5 | 1.76 | 0.46 | 0.94 | 1.14 | 0.70 | 0.74 | 0.88 |
| Santotrac 50 | (Monsanto) | 12.80 | 219.3 | 221.6 | 3.10 | 0.04 | 1.02 | 1.01 | 1.24 | 0.99 | 1.07 |
| Coal Tar | Feed | 3.30 | 578.9 | 419.7 | 0.96 | 1.04 | 3.85 | 0.20 | 0.38 | −0.08 | 1.09 |
| Coal Tar | Hydrogenated | 2.90 | 212.6 | 187.8 | 1.04 | 0.04 | 0.54 | 0.88 | 0.42 | 0.96 | 0.70 |
| Coal Tar | Hyd./Dist. #3 | 3.58 | 193.1 | 189.2 | 1.30 | 0.04 | 0.56 | 0.98 | 0.52 | 0.97 | 0.76 |
| Coal Tar | Hyd./Dist. #4 | 12.50 | 188.1 | 190.9 | 3.75 | 0.06 | 0.58 | 1.01 | 1.50 | 0.98 | 1.02 |
| Coal Tar | Hyd./T.D. #7 (Thermal diff.) | 3.80 | 206.8 | 196.3 | 1.32 | 0.04 | 0.66 | 0.95 | 0.53 | 0.97 | 0.78 |
| Coal Tar | Hyd./T.D. #8 | 5.10 | 203.5 | 197.3 | 1.40 | 0.04 | 0.68 | 0.97 | 0.68 | 0.97 | 0.83 |
| Coal Tar | Hyd./T.D. #9 | 7.40 | 202.2 | 200.1 | 1.83 | 0.04 | 0.72 | 0.99 | 0.73 | 0.98 | 0.86 |
| Coal Tar | Hyd./T.D. #10 | 25.50 | 190.3 | 200.5 | 4.72 | 0.04 | 0.72 | 1.05 | 1.89 | 0.99 | 1.16 |

TABLE IV

ANALYSIS OF HYDROGENATED COAL TAR DISTILLATION AND THERMAL DIFFUSION FRACTIONS[a]

| | Feed | Port #3 | Port #7 | Port #9 | Port #10 | Cut #3 | Cut #4 |
|---|---|---|---|---|---|---|---|
| Silica Gel Analysis | | | | | | | |
| Saturates, wt % | 78.3 | 98.9 | 92.0 | 64.8 | 38.0 | 94.8 | 58.0 |
| Aromatics, wt % | 19.6 | 0.0 | 6.7 | 33.2 | 56.0 | 4.8 | 37.7 |
| Polar Compounds, wt % | 2.1 | 1.1 | 1.3 | 2.0 | 6.1 | 0.3 | 4.3 |
| Recovery, wt % | 100.0 | 100.0 | 100.0 | 100.0 | 100.1 | 99.9 | 100.0 |
| Mass Spec Analysis | | | | | | | |
| Saturates (LV% on Saturates) | | | | | | | |
| Paraffins | 0.05 | 0.00 | 0.00 | 0.00 | 0.00 | 0.60 | 2.22 |
| 1-Ring | 14.66 | 26.55 | 8.66 | 3.62 | 2.10 | 12.40 | 3.76 |
| 2-Ring | 22.75 | 33.66 | 22.41 | 9.79 | 6.52 | 23.24 | 12.30 |
| 3-Ring | 27.66 | 32.07 | 30.48 | 19.36 | 18.58 | 41.24 | 15.87 |
| 4-Ring | 22.46 | 3.69 | 23.06 | 42.68 | 49.72 | 9.22 | 49.31 |
| 5-Ring | 0.00 | 0.00 | 0.00 | 0.00 | 0.00 | 0.00 | 0.00 |
| 6-Ring | 0.00 | 0.00 | 0.00 | 0.00 | 0.00 | 0.00 | 0.00 |
| Mono-aromatics | 12.42 | 4.03 | 15.40 | 24.55 | 23.09 | 13.31 | 16.55 |
| | 100.00 | 100.00 | 100.00 | 100.00 | 100.00 | 100.00 | 100.00 |
| Aromatics (LV % on Aromatics) | | | | | | | |
| Alkyl Benzenes | 1.86 | — | 2.16 | 1.14 | 1.17 | 2.38 | 1.93 |
| Mononaphthene Benzenes | 6.05 | — | 8.94 | 4.77 | 3.06 | 9.12 | 4.37 |
| Dinaphthene Benzenes | 29.65 | — | 60.23 | 24.69 | 13.79 | 72.15 | 18.55 |
| Naphthalenes | 33.89 | — | 20.78 | 45.72 | 32.09 | 13.12 | 37.81 |
| Acenaphthenes | 13.02 | — | 2.09 | 8.68 | 24.23 | 0.40 | 17.15 |
| Fluorenes | 6.29 | — | 2.18 | 6.38 | 9.23 | 0.38 | 8.30 |
| Phenanthrenes | 2.67 | — | 0.47 | 1.39 | 5.10 | 0.12 | 3.73 |
| Naphthenephenanthrenes | 0.65 | — | 0.00 | 0.11 | 1.64 | 0.00 | 1.04 |
| Pyrenes | 0.28 | — | 0.03 | 0.31 | 1.07 | 0.00 | 0.58 |
| Chrysenes | 0.00 | — | 0.00 | 0.00 | 0.00 | 0.00 | 0.00 |

TABLE IV-continued

ANALYSIS OF HYDROGENATED COAL TAR DISTILLATION AND THERMAL DIFFUSION FRACTIONS[a]

| | Feed | Port #3 | Port #7 | Port #9 | Port #10 | Cut #3 | Cut #4 |
|---|---|---|---|---|---|---|---|
| Perylenes | 0.45 | — | 0.02 | 0.23 | 0.90 | 0.00 | 0.57 |
| Dibenzanthracenes | 0.08 | — | 0.00 | 0.02 | 0.18 | 0.00 | 0.11 |
| Benzothiophenes | 0.91 | — | 1.10 | 1.59 | 1.21 | 0.95 | 1.04 |
| Dibenzothiophenes | 4.12 | — | 2.01 | 4.93 | 6.22 | 1.37 | 4.77 |
| Naphthobenzothiophenes | 0.05 | — | 0.00 | 0.04 | 0.10 | 0.00 | 0.06 |
| Unidentifiable Aromatics | 0.01 | — | 0.00 | 0.00 | 0.00 | 0.00 | 0.00 |
| | 100.00 | — | 100.00 | 100.00 | 100.00 | 100.00 | 100.00 |
| Summary from Mass Spec Plus Silica Gel Analysis | | | | | | | |
| Saturates (LV % on Total) | | | | | | | |
| Paraffins | 0.04 | 0.00 | 0.00 | 0.00 | 0.00 | 0.57 | 1.29 |
| 1–2 Ring | 29.29 | 59.55 | 28.58 | 8.69 | 3.28 | 33.79 | 9.31 |
| 3–6 Ring | 39.24 | 35.37 | 49.26 | 40.20 | 25.95 | 47.84 | 37.80 |
| Mono-aromatics | 9.72 | 3.99 | 14.17 | 15.91 | 8.77 | 12.62 | 9.60 |
| Aromatics (LV % on Total) | | | | | | | |
| Single Ring | 7.36 | — | 4.78 | 10.16 | 10.09 | 4.02 | 9.37 |
| Multi-Ring | 11.24 | — | 1.71 | 20.86 | 41.69 | 0.67 | 26.12 |
| Sulfur | 1.00 | — | 0.21 | 2.18 | 4.22 | 0.11 | 2.21 |
| Unidentifiable Aromatics | 0.00 | — | 0.00 | 0.00 | 0.00 | 0.00 | 0.00 |
| Polar Compounds (LV % on Total) | 2.10 | 1.10 | 1.30 | 2.00 | 6.10 | 0.30 | 4.30 |
| Total | 99.99 | 100.01 | 100.01 | 100.00 | 100.10 | 99.92 | 100.00 |

[a]The wt % recovery is adjusted to 100.0% by proportional adjustments to each fraction.

What is claimed is:

1. In the method of operating a traction drive the improvement comprising using as the traction lubricant a traction fluid having a lubricant basestock comprising hydrogenated coal tar which contains a saturate fraction and an aromatic fraction which comprises at least about 12% by weight of said fluid, said saturate fraction having a volume ratio of at least about 1:1 multiring components of at least three rings to 1–2 ring components, and said aromatic fraction containing at least about 50% by volume of multiring components having two or more rings at least one of which is an aromatic ring.

2. The method of claim 1 wherein the traction fluid has a weight ratio of aromatic fraction to saturate fraction of at least about 0.1:1.

3. The method of claim 1 wherein the traction fluid has a weight ratio of aromatic fraction to saturate fraction of at least about 0.2:1.

4. The method of claim 3 wherein said aromatic fraction comprises at least about 20% by weight of the fluid.

5. The method of claim 4 wherein the saturate fraction of said fluid has a volume ratio of at least about 3:1 multiring to 1–2 ring components.

6. The method of claim 5 wherein said aromatic fraction contains at least about 60% by volume of multiring components.

7. The method of claim 6 wherein said aromatic fraction comprises at least about 30% by weight of the fluid.

8. The method of claim 7 wherein said saturate fraction has a ratio of at least about 4:1 multiring to 1–2 ring components.

9. The method of claim 8 wherein the traction fluid has a weight ratio of aromatic fraction to saturate fraction of at least about 0.5:1.

10. The method of claim 9 wherein said aromatic fraction contains at least about 66.7% by volume of multiring components.

11. The method of claim 9 wherein said aromatic fraction comprises naphthalenes, acenphthenes, fluorenes and phenanthrenes.

* * * * *